US008919889B2

(12) United States Patent
Kane et al.

(10) Patent No.: US 8,919,889 B2
(45) Date of Patent: Dec. 30, 2014

(54) ADJUSTABLE HARNESS AND CHAIR THEREWITH

(71) Applicants: Schantal M. Kane, Downingtown, PA (US); Curtis M. Hartenstine, Birdsboro, PA (US)

(72) Inventors: Schantal M. Kane, Downingtown, PA (US); Curtis M. Hartenstine, Birdsboro, PA (US)

(73) Assignee: Wonderland Nurserygoods Company Limited, Kwai Chung, N.T. (HK)

( * ) Notice: Subject to any disclaimer, the term of this patent is extended or adjusted under 35 U.S.C. 154(b) by 0 days.

(21) Appl. No.: 13/677,262

(22) Filed: Nov. 14, 2012

(65) Prior Publication Data

US 2013/0119718 A1 May 16, 2013

Related U.S. Application Data

(60) Provisional application No. 61/629,224, filed on Nov. 15, 2011.

(30) Foreign Application Priority Data

Oct. 29, 2012 (CN) ..... 2012 2 0560510 U
Nov. 13, 2012 (CN) ..... 2012 1 0453650

(51) Int. Cl.
*A47D 15/00* (2006.01)
*A62B 35/00* (2006.01)
*A47D 1/00* (2006.01)

(52) U.S. Cl.
CPC ..... *A47D 15/006* (2013.01); *A47D 1/002* (2013.01)
USPC ..... 297/484

(58) Field of Classification Search
USPC ..... 297/484, 250.1, 483
See application file for complete search history.

(56) References Cited

U.S. PATENT DOCUMENTS

| | | | | | |
|---|---|---|---|---|---|
| 3,910,634 | A * | 10/1975 | Morris | 297/467 |
| 4,402,548 | A * | 9/1983 | Mason | 297/464 |
| 5,156,436 | A * | 10/1992 | Grene | 297/466 |
| 6,155,638 | A | 12/2000 | Bapst | |
| 6,398,302 | B1 | 6/2002 | Freedman | |
| 6,637,826 | B2 * | 10/2003 | Takayama | 297/484 |
| 6,698,841 | B1 * | 3/2004 | Glover et al. | 297/484 |
| 2007/0200404 | A1 | 8/2007 | Canna | |
| 2008/0258527 | A1 * | 10/2008 | Gower et al. | 297/256.15 |

FOREIGN PATENT DOCUMENTS

| | | |
|---|---|---|
| BE | 801648 | 1/1974 |
| EP | 0 770 515 A2 | 5/1997 |
| EP | 1 277 423 A1 | 1/2003 |
| EP | 2 275 328 A1 | 1/2011 |
| GB | 1 268 761 | 3/1972 |
| GB | 2 247 606 A | 3/1992 |

* cited by examiner

*Primary Examiner* — Milton Nelson, Jr.
(74) *Attorney, Agent, or Firm* — Winston Hsu; Scott Margo

(57) ABSTRACT

An adjustable harness and a chair therewith are disclosed. The adjustable harness includes an attachment component, an adjustment component, and a shoulder strap. The attachment component is fixedly disposed on a backrest of a chair. The adjustment component is disposed on the attachment component and capable of being operated to move relative to the attachment component. An end of the shoulder strap is connected to the adjustment component. Thereby, the attachment component and the adjustment component function as an adjustment mechanism, by which a user can simply and fast adjust the shoulder strap, so as to solve the problem of tediousness and time consuming in adjusting restraint systems in the prior art.

14 Claims, 15 Drawing Sheets

ADJUSTABLE HARNESS AND CHAIR THEREWITH

CROSS REFERENCE TO RELATED APPLICATIONS

This application claims the benefit of U.S. Provisional Application No. 61/629,224, which was filed on Nov. 15, 2011, and is incorporated herein by reference.

BACKGROUND OF THE INVENTION

1. Field of the Invention

The invention relates to a chair with safety harness, and especially relates to an adjustable harness and a chair therewith.

2. Description of the Prior Art

High chairs provide a safe and comfortable sitting area that can be used for feeding, crafting activities or simply containing an infant or small child for a period of time. Because of the nature of an elevated seating area, a high chair is usually required to contain a safety restraint system that is adjustable for a certain range in height and weight of infants and children. In addition, restraint systems often contain removable infant inserts for comfort and are currently adjusted by weaving the shoulder straps in and out of slots molded into the backrest which can be tedious and time consuming.

SUMMARY OF THE INVENTION

An objective of the invention is to provide an adjustable harness, installed on a chair. The adjustable harness uses a vertical adjustment mechanism for adjusting shoulder straps thereof simply and fast.

The adjustable harness includes an attachment component, an adjustment component, and a shoulder strap. The attachment component is fixedly disposed on a backrest of the chair. The adjustment component is disposed on the attachment component and capable of being operated to move relative to the attachment component. An end of the shoulder strap is connected to the adjustment component. Thereby, the attachment component and the adjustment component function as an adjustment mechanism. A user can simply and fast operate the adjustment component in coordination with the attachment component to perform adjusting of the shoulder strap, so as to solve the problem of tediousness and time consuming in adjusting restraint systems in the prior art.

Another objective of the invention is to provide a chair having adjustable harness. Similarly, a user can adjust shoulder straps of the chair simply and fast.

The chair comprises a backrest, an attachment component, an adjustment component, and a shoulder strap. The attachment component is fixedly disposed on the backrest. The adjustment component is disposed on the attachment component and capable of being operated to move relative to the attachment component. An end of the shoulder strap is connected to the adjustment component. Similarly, the attachment component and the adjustment component function as an adjustment mechanism; a user can adjust the shoulder strap simply and fast by operating the adjustment mechanism.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
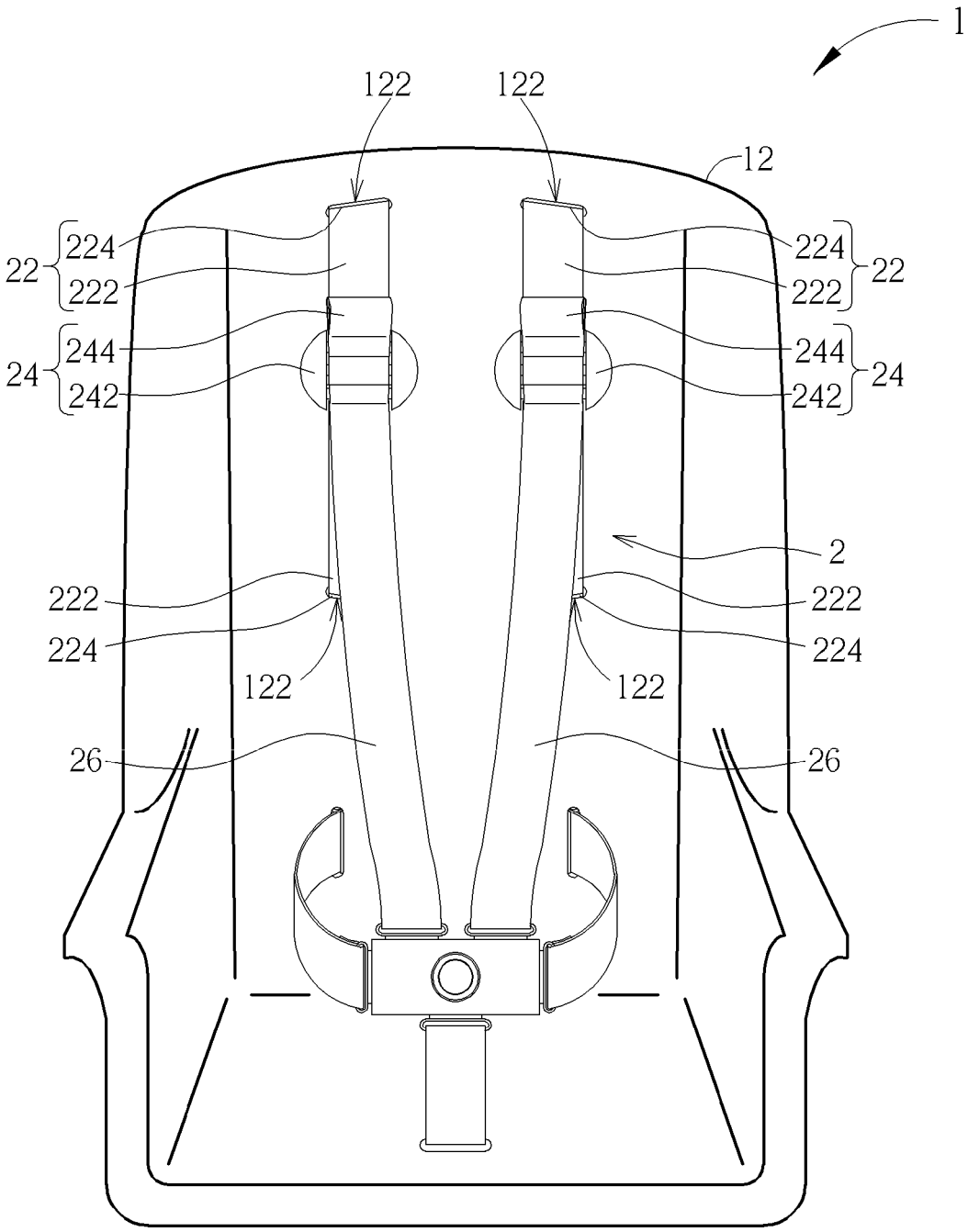
FIG. 1 is a schematic diagram illustrating a chair with an adjustable harness of a first preferred embodiment according to the invention.
Figure 2:
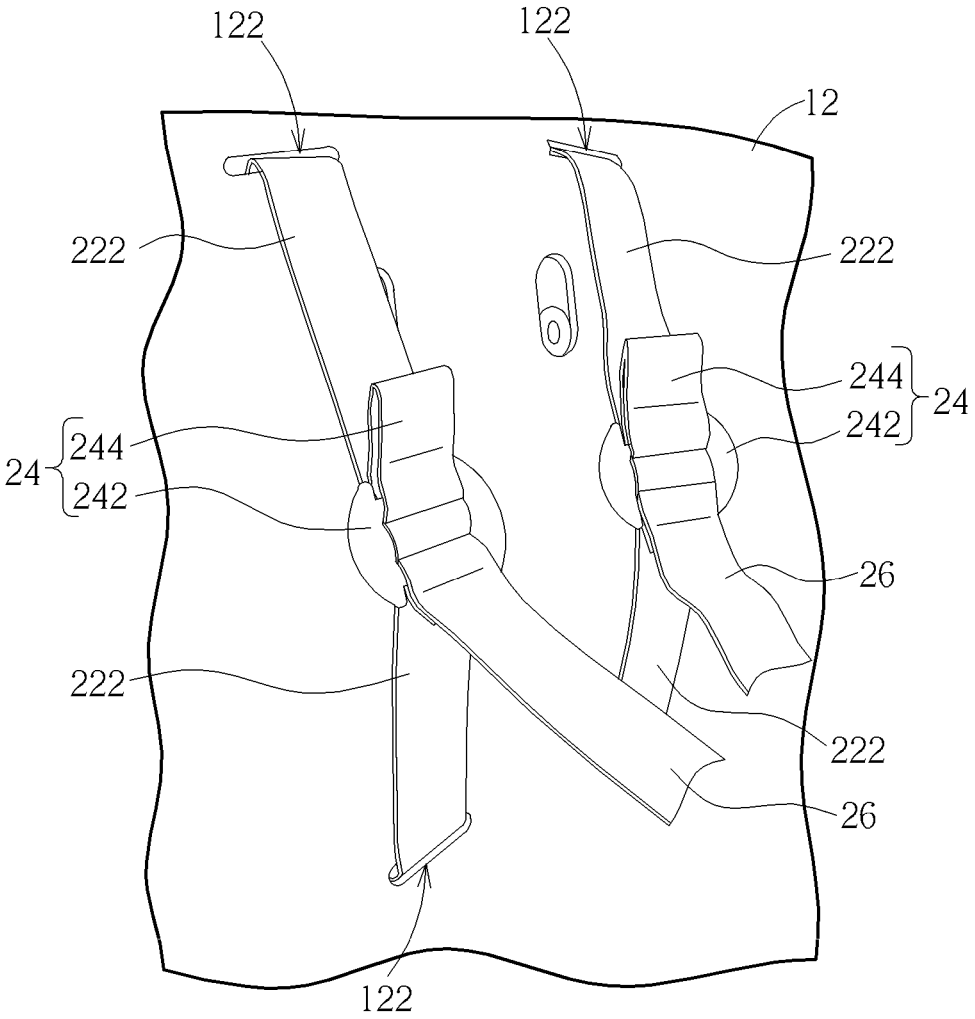
FIG. 2 is an enlarged view of a part of the adjustable harness in FIG. 1.
Figure 3:
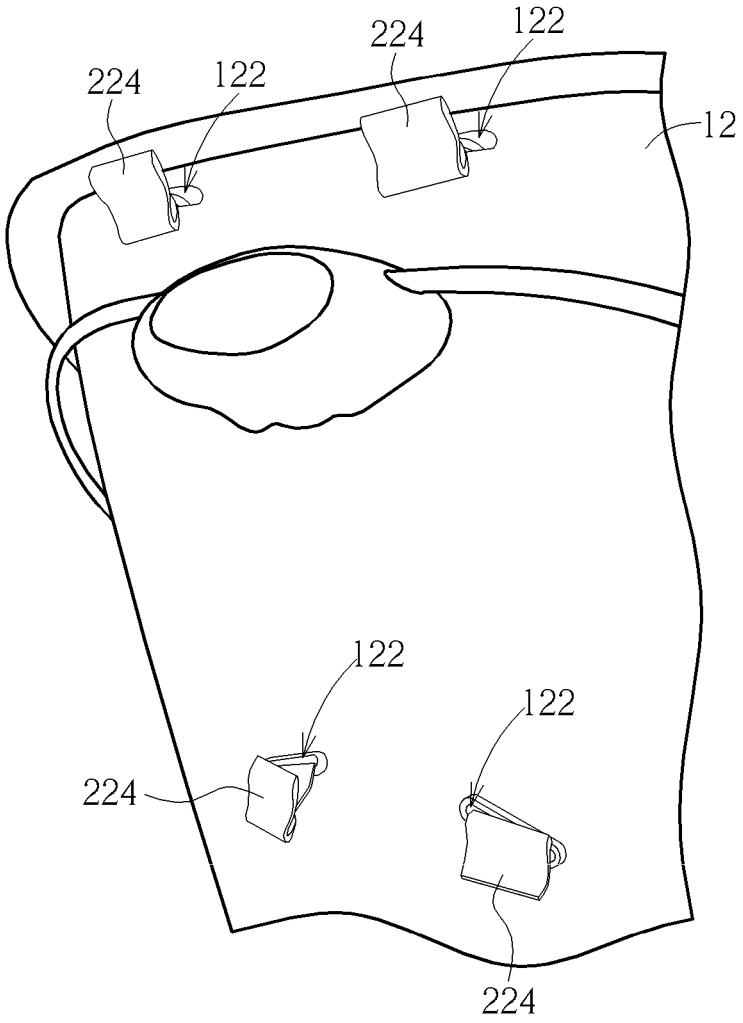
FIG. 3 is a schematic diagram illustrating the backside of a backrest of the chair in FIG. 1.

Please refer to FIGS. 1 through 3. FIG. 1 is a schematic diagram illustrating a chair 1 with an adjustable harness 2 of a first preferred embodiment according to the invention. FIG. 2 is an enlarged view of a part of the adjustable harness 2. FIG. 3 is a schematic diagram illustrating the backside of a backrest 12 of the chair 1. The adjustable harness 2 is installed on the chair 1 and includes two attachment components 22, two adjustment components 24, and two shoulder straps 26, and other required components. Each shoulder strap 26 corresponds to one attachment 22 and one adjustment components 24. The attachment component 22 is fixedly disposed on the backrest 12. The adjustment component 24 is disposed on the corresponding attachment component 22 and capable of being operated to move relative to the corresponding attachment component 22. An end of the shoulder strap 26 is connected to the corresponding adjustment component, so as to capable of being moved together with the corresponding attachment component 22. Thereby, a user can simply and fast operate the adjustment component in coordination with the corresponding attachment component to perform adjusting of the corresponding shoulder strap 26.

In the embodiment, the attachment component 22 includes an attachment strap 222 and two retainers 224 at the two ends of the attachment strap 222. The retainers 224 can be made by means of a butterfly sewing method, but the invention is not limited thereto. The backrest 12 has keyed slots 122 corresponding to the retainers 224. The two ends of attachment strap 222 are mounted on the backrest 12 by inserting the retainers 224 into the corresponding keyed slots 122. The attachment strap 222 passes through the adjustment component 24.

Figure 4:
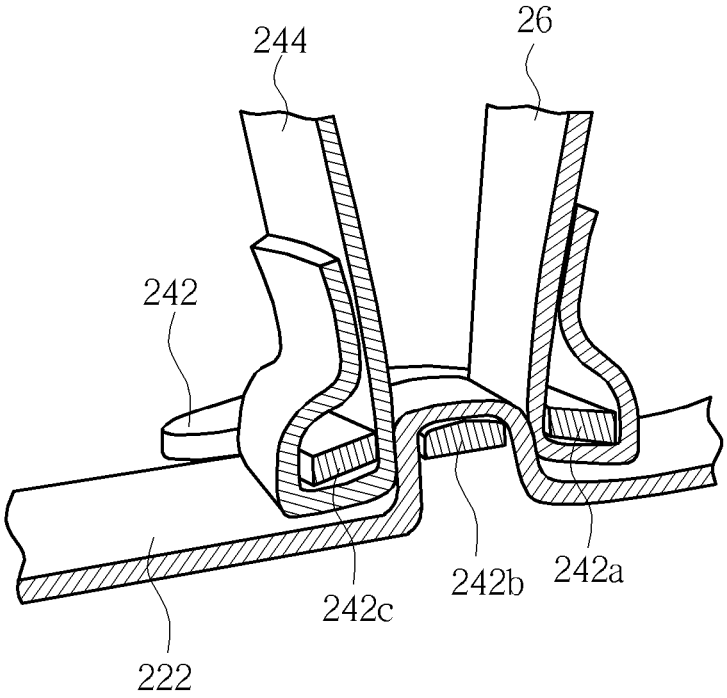
FIG. 4 is a sectional view of the adjustment component of the adjustable harness in FIG. 1.

Please also refer to FIG. 4. FIG. 4 is a sectional view of the adjustment component 24. The adjustment component 24 includes a tri-glide buckle 242. The attachment strap 222 is woven through three bars 242*a*, 242*b* and 242*c* of the tri-glide buckle 242. The end of the shoulder strap 26 is attached by sewing onto the lower one 242*a* of the three bars 242*a*, 242*b* and 242*c* of the tri-glide buckle 242. The adjustable harness 2 further includes a pulling tab 244 attached by sewing onto the upper one 242*c* of the three bars 242*a*, 242*b* and 242*c* of the tri-glide buckle 242. Thereby, the shoulder straps 26 can move together with the tri-glide buckles 242 without detaching the adjustable harness 2 from the backrest 12.

Figure 5:
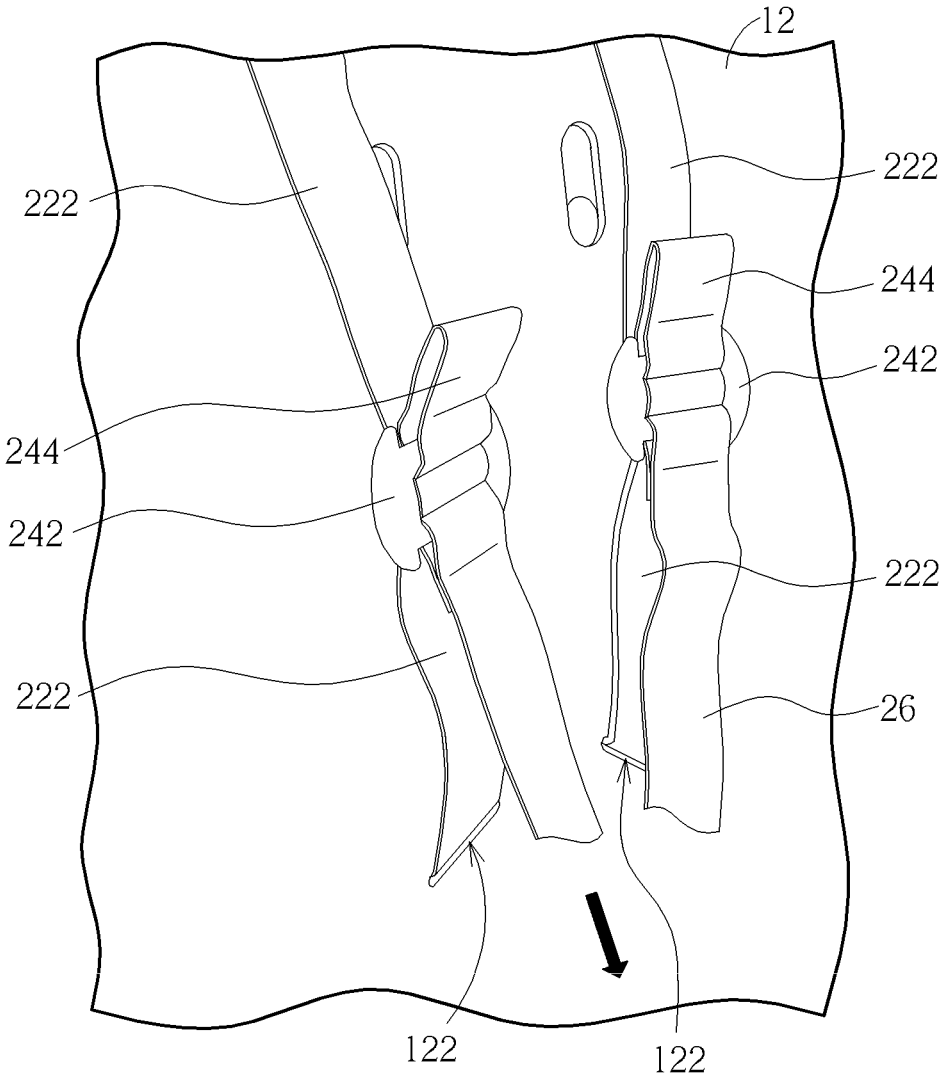
FIG. 5 is a schematic diagram illustrating a shoulder strap is pulled substantially parallel to an attachment strap of the adjustable harness in FIG. 1.
Figure 6:
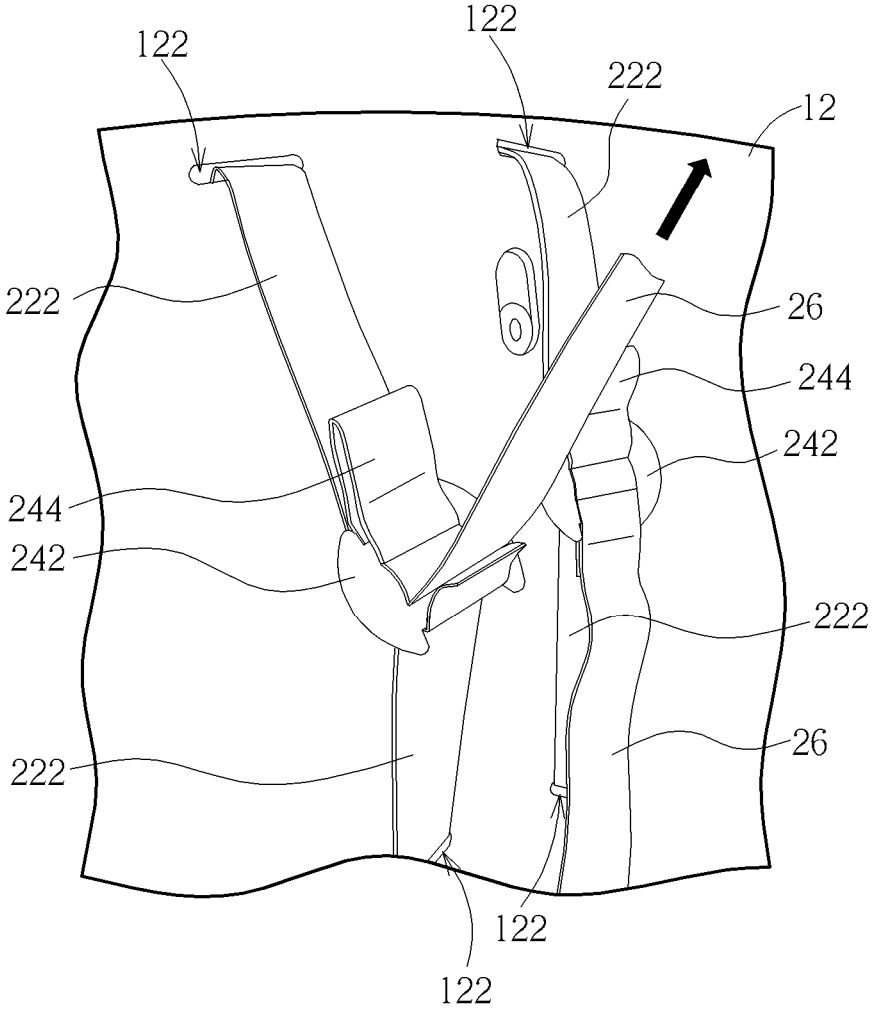
FIG. 6 is a schematic diagram illustrating the shoulder strap is pulled non-parallel to the attachment strap of the adjustable harness in FIG. 1.

Please refer to FIG. 5 and FIG. 6 for the movement mechanism of the tri-glide buckle 242. FIG. 5 is a schematic diagram illustrating the shoulder strap 26 is pulled substantially parallel to the attachment strap 222. FIG. 6 is a schematic diagram illustrating the shoulder strap 26 is pulled non-parallel to the attachment strap 222. The pulling direction is indicated by an arrow in the figures. When the tri-glide buckle 242 is applied with a force substantially parallel to the attachment strap 222 away from the tri-glide buckle 242, the tri-glide buckle 242 can slide on the attachment strap 222 for adjusting the shoulder strap 26. In practice, the parallel force can be produced by pulling the shoulder strap 26 downward (as shown in FIG. 5) or pulling the pulling tab 244 upward. Therein, the pulling tab 244 can assist with an upward adjustment of the tri-glide buckle 242.

In another aspect, when the tri-glide buckle 242 is applied with a force non-parallel to the attachment strap 222 away from the tri-glide buckle 242, the tri-glide buckle 242 can locks the attachment strap 222 for maintaining the relative position of the shoulder strap 26 to the attachment component 22. In practice, the non-parallel force can be produced by pulling the shoulder strap 26 upward, as shown in FIG. 6. In a practical application, the shoulder strap 26 is wound around the front of the child seated on the chair 1, so that the shoulder strap 26 is connected to the tri-glide buckle 242 non-parallel to the attachment strap 222. If the child wants to get out of the chair 1, the shoulder strap 26 will be dragged by the child to pull the tri-glide buckle 242 with a force non-parallel to the attachment strap 222. Such non-parallel force makes the tri-glide buckle 242 lock the attachment strap 222, so the child can be firmly seated on the chair 1 for safety.

Figure 7:
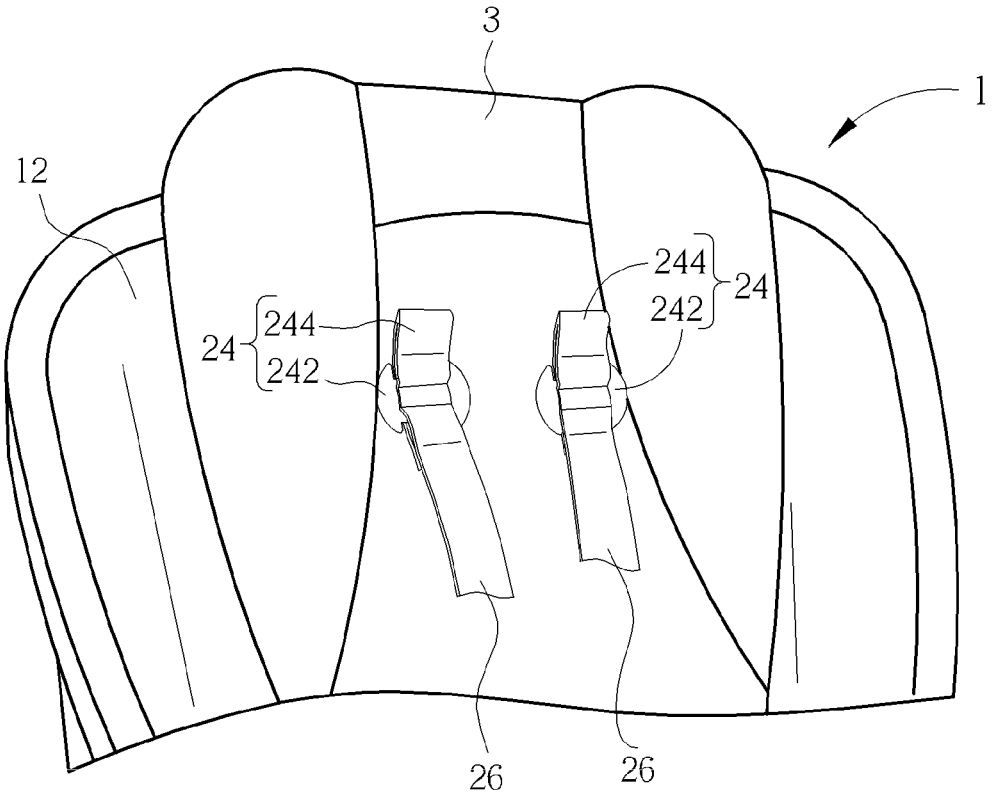
FIG. 7 is a schematic diagram illustrating the chair in FIG. 1 equipped with an infant insert.
Figure 8:
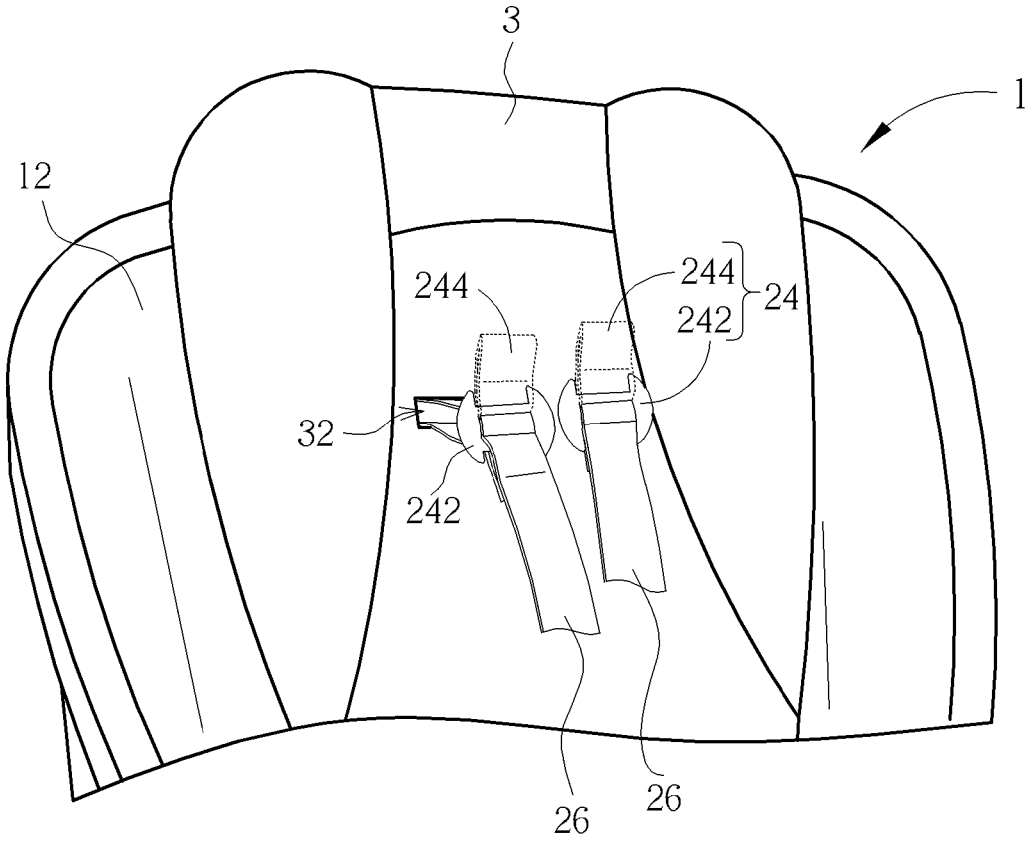
FIG. 8 is a schematic diagram illustrating the chair equipped with an infant insert according to another embodiment.
Figure 9:
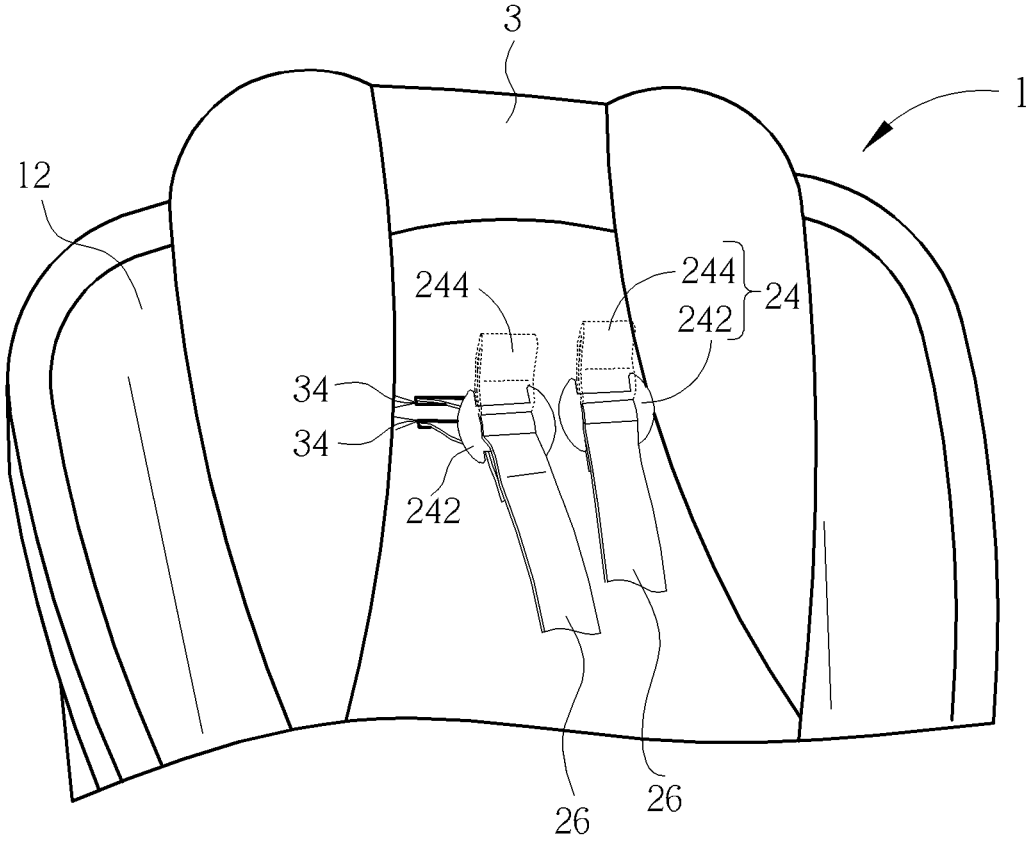
FIG. 9 is a schematic diagram illustrating the chair equipped with an infant insert according to another embodiment.

In addition, an infant insert 3 can be attached behind the tri-glide buckle 242 by means of weaving the adjustable harness 2 through button holes formed on the infant insert 3 and fixing the infant insert 3 between the tri-glide buckle 242 and the attachment strap 222 opposite to the shoulder strap 26, as shown in FIG. 7. Because the infant insert 3 is disposed opposite to the shoulder strap 26, infant insert 3 will not interfere with the adjustment of the shoulder straps 26. Furthermore, this configuration allows the infant insert 3 to move with the shoulder straps 26 during the adjustment of the shoulder straps 26. Therefore, when a user adjusts the shoulder straps 26, it is unnecessary for the user to adjust the infant insert 3 in addition. In practice, the infant insert 3 thereon can form one button hole 32 corresponding to one tri-glide buckle 242. The button hole 32 allows the attachment strap 222 to pass through, such that the infant insert 3 can be attached between the attachment strap 222 and the tri-glide buckle 242, as shown in FIG. 8. Therein, the left tri-glide buckle 242 departs form the infant insert 3 in a distance for showing a clear illustration of the attachment strap 222 passing through the button hole 32. In the case, a structural constraining force exists between the infant insert 3 and the tri-glide buckle 242. The user can directly pull the infant insert 3 upward or downward to make the tri-glide buckle 242 move relative to the attachment strap 222, so in the embodiment, the pulling tab 244 can be skipped and is shown in dashed lines in FIG. 8. In addition, in practice, the infant insert 3 thereon can form two button holes 34 corresponding to one tri-glide buckle 242. The two button holes 34 allows the attachment strap 222 to pass through respectively, such that the infant insert 3 can be attached between the attachment strap 222 and the tri-glide buckle 242 more stably, as shown in FIG. 9. Therein, the left tri-glide buckle 242 departs form the infant insert 3 in a distance for showing a clear illustration of the attachment strap 222 passing through the button holes 34. Similarly, the user can directly pull the infant insert 3 upward or downward to adjust the position of the tri-glide buckle 242 relative to the attachment strap 222. In the case, the pulling tab 244 also can be skipped and is shown in dashed lines in FIG. 9.

Figure 10:
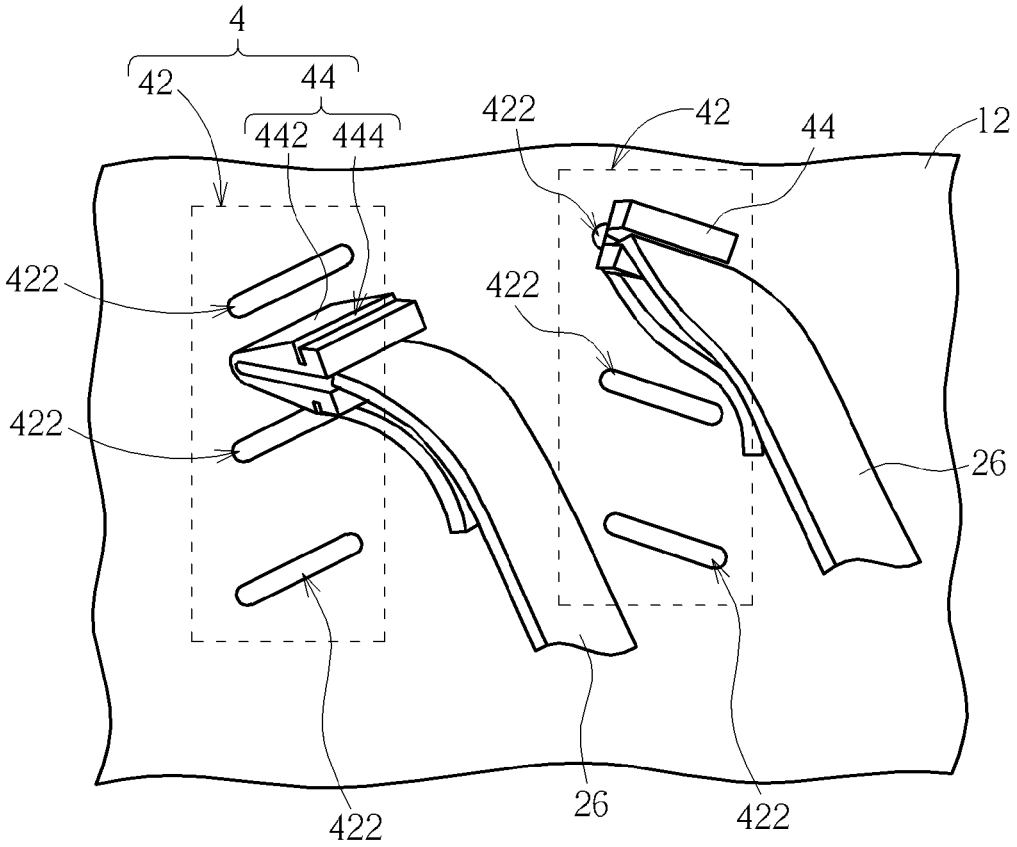
FIG. 10 is a schematic diagram illustrating a part of the chair with an adjustable harness of a second preferred embodiment according to the invention.

Please refer to FIG. 10, which is a schematic diagram illustrating a part of the chair 1 with an adjustable harness 4 of a second preferred embodiment according to the invention. The adjustable harness 4 is similar in logical structure to the adjustable harness 2. The following will be concentrated on the difference therebetween. For other description of the adjustable harness 4, please refer to the relevant descriptions of the adjustable harness 2. The difference between the adjustable harness 4 and the adjustable harness 2 is that the adjustable harness 4 uses a different adjustment mechanism. The adjustable harness 4 includes two attachment components 42 (indicated by frames in dashed lines) and two corresponding adjustment components 44. The attachment component 42 includes a plurality of keyed slots 422, directly formed on the backrest 12. The corresponding adjustment component 44 includes a flexible member 442 and a groove 444. In the embodiment, the flexible member 442 is realized by a V-shaped clip which has a wedge portion and a blocking portion. The groove 444 is formed between the wedge portion and the blocking portion. The end of the shoulder strap 26 is fixed on the flexible member, precisely at the blocking portion.

The flexible member 242 is resiliently compressible so as to be selectively inserted into one of the keyed slots 422. Because of the resilience of the flexible member 442, the flexible member 442 will decompress after the wedge portion fully passes through the keyed slot 422, such that the groove 444 is engaged with the keyed slot 422 for locking thereto. At this moment, the edge of the keyed slot 422 is embedded in the groove 444, and the wedge portion and the blocking portion are located at opposite sides of the backrest 12, so that the adjustment component 44 is firmly attached to the backrest 12. To remove the shoulder strap 26, the flexible member 442 must be manually compressed such as by compressing the blocking portion and removed from the keyed slot 422. Therefore, a user can easily operate the flexible member 442 by single hand, providing convenient operation. In addition, similarly, an infant insert can be attached to the adjustment component 44 by means of weaving and fixing the infant insert through button holes.

Figure 11:
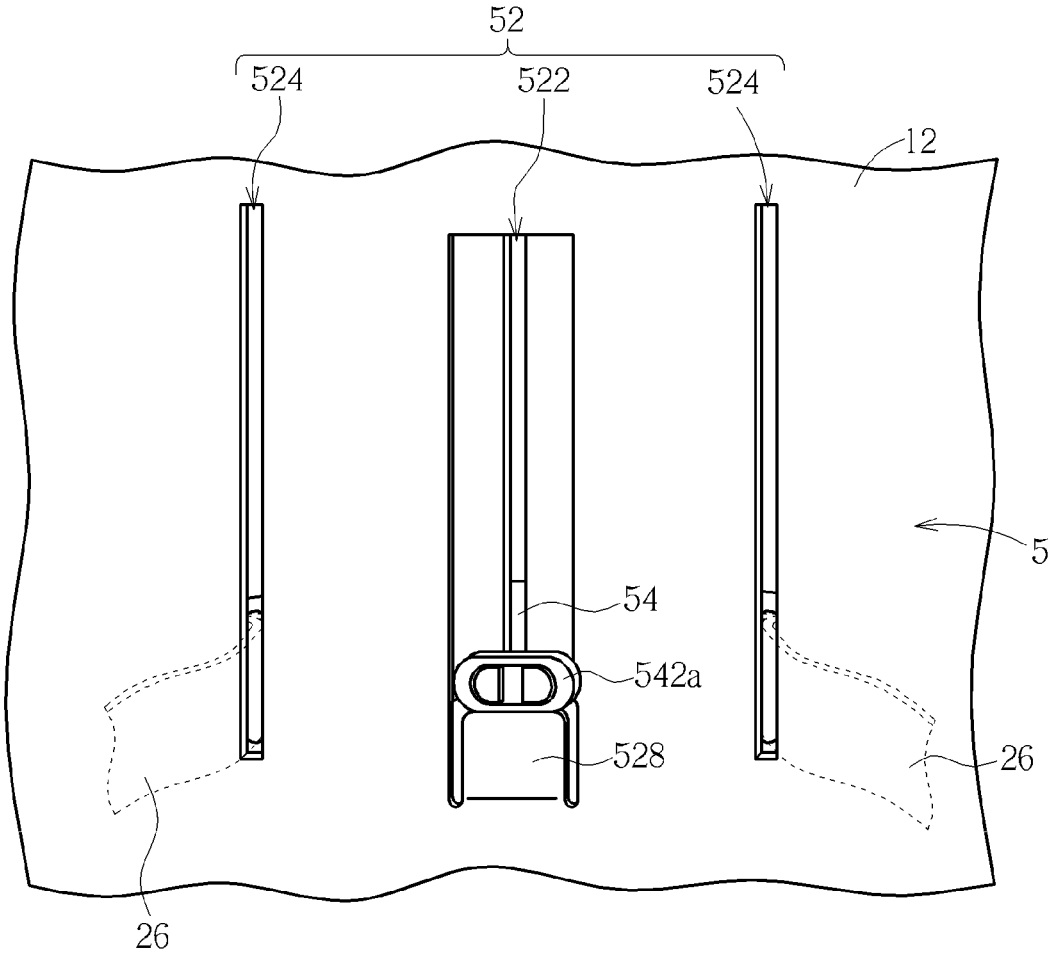
FIG. 11 is a schematic diagram illustrating a part of the chair with an adjustable harness of a third preferred embodiment according to the invention.
Figure 12:
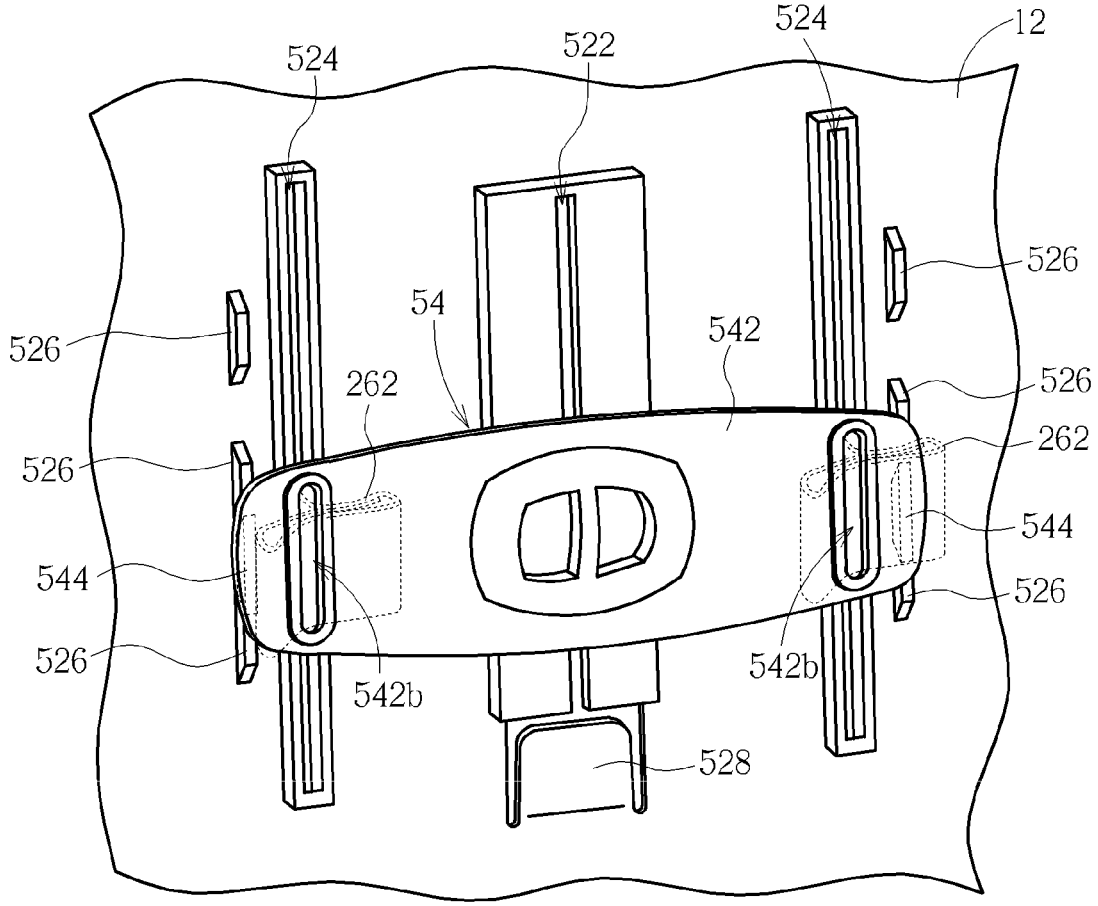
FIG. 12 is a schematic diagram illustrating the backside of the backrest of the chair in FIG. 11.

Please refer to FIG. 11 and FIG. 12. FIG. 11 is a schematic diagram illustrating apart of the chair 1 with an adjustable harness 5 of a third preferred embodiment according to the invention. FIG. 12 is a schematic diagram illustrating the backside of the backrest 12 of the chair 1. The adjustable harness 5 is similar in logical structure to the adjustable harness 2. The difference between the adjustable harness 5 and the adjustable harness 2 is that the adjustable harness 5 uses a different sliding adjustment mechanism. The following will be concentrated on the difference therebetween. For other description of the adjustable harness 5, please refer to the relevant descriptions of the adjustable harness 2. The adjustable harness 5 includes an attachment component 52 and a corresponding adjustment component 54. The attachment component 52 includes a guiding slot 522 and two relief slots 524; in the embodiment, the guiding slot 522 and the relief slots 524 are directly formed on the backrest 12 and extend parallel.

The adjustment component 54 includes a sliding member 542. The sliding member 542 has a retaining part 542*a* at its middle portion, passing through the guiding slot 522 such that the sliding member 542 can vertically slide on the guiding slot. The sliding member 542 also has two keyed slots 542*b* formed at its two side portions and corresponding to the two relief slots 524 respectively. The shoulder straps 26 (shown by dashed lines in the figures) are attached to the two side portions of the sliding member 542 respectively. The shoulder strap 26 has a retainer 262 at its end for being attached to the sliding member 542. The retainer 262 can be made by means of a butterfly sewing method, but the invention is not limited thereto. The retainer 262 passes through the corresponding relief slot 524 to be fixed at the corresponding keyed slot 542*b*. Thereby, the shoulder straps 26 can move together with the sliding member 542 without detaching the adjustable harness 5 from the backrest 12.

In the embodiment, the attachment component 52 further includes a plurality of first ramped protrusions 526, formed on the backrest 12. The first ramped protrusions 526 are separately arranged parallel to the relief slot 524 (or the guiding slot 522). The adjustment component 54 includes two second ramped protrusions 544 (shown by hidden lines in FIG. 12), disposed on the sliding member 542 and corresponding to the first ramped protrusions 526. The sliding member 542 can provide a certain elastic deflection at its side portions, so the second ramped protrusion 544 is capable of moving with the sliding member 542 to be selectively embedded between the first ramped protrusions 526 for locating the sliding member 542. Furthermore, to avoid the disengagement of the sliding member 542 from the guiding slot 522, the attachment component 52 further includes a one-time snap 528 at a bottom opening end of the guiding slot 522 for obstructing the retaining part 542*a*. In addition, similarly, an infant insert can be attached to the retaining part 542*a* from the front side of the backrest 12.

Figure 13:
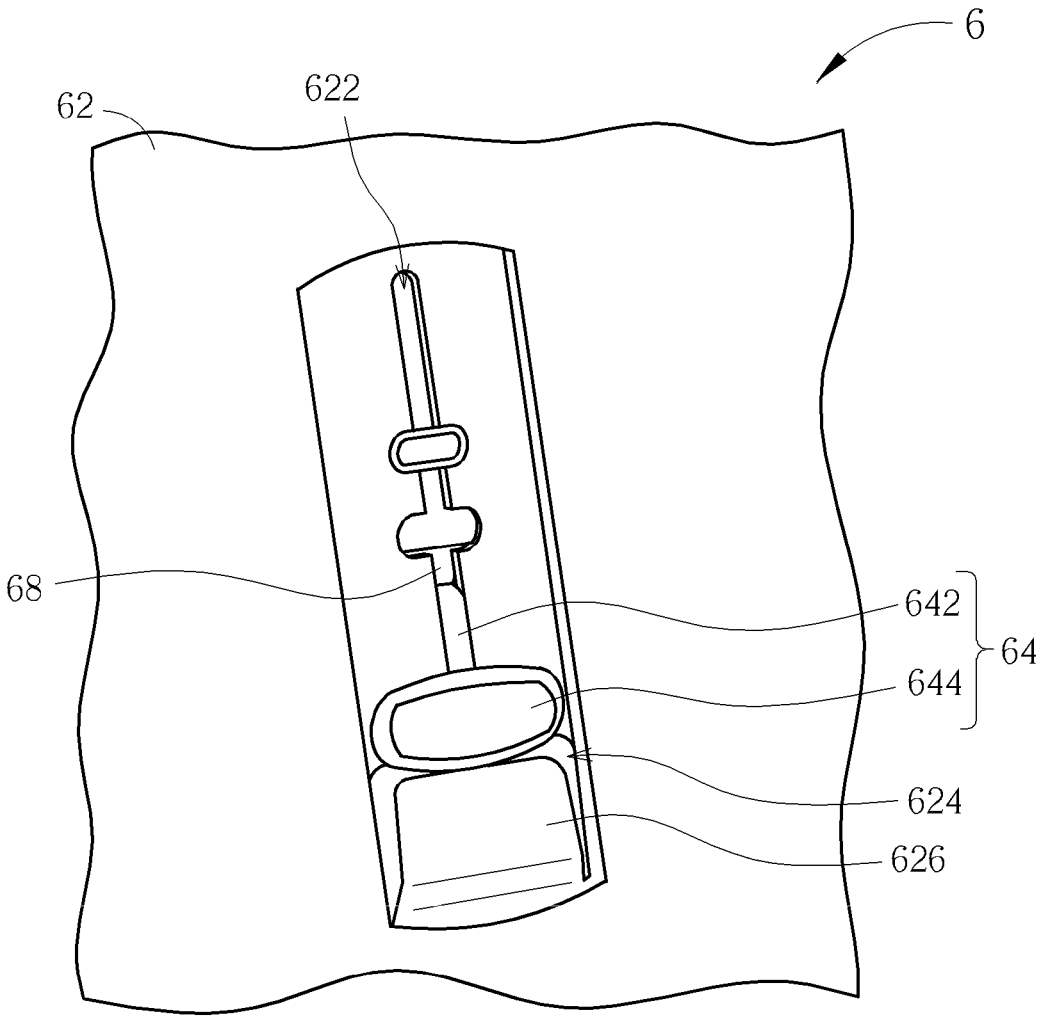
FIG. 13 is a schematic diagram illustrating a part of a chair further with a recliner handle of a fourth preferred embodiment according to the invention.
Figure 14:
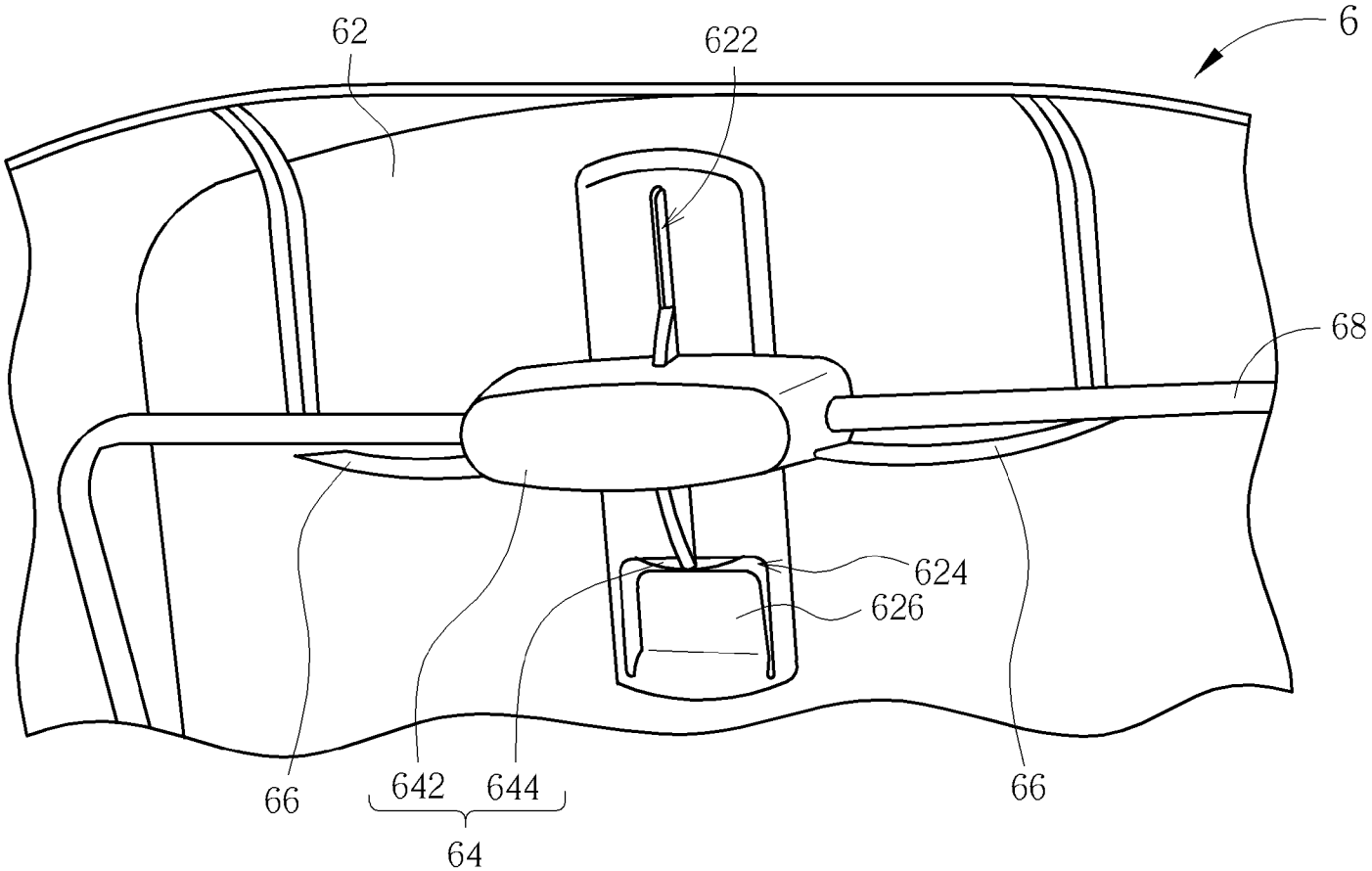
FIG. 14 is a schematic diagram illustrating the backside of a backrest of the chair in FIG. 13.

Please refer to FIG. 13 and FIG. 14. FIG. 13 is a schematic diagram illustrating apart of a chair 6 further with a recliner handle of a fourth preferred embodiment according to the invention. FIG. 14 is a schematic diagram illustrating the backside of a backrest 62 of the chair 6. The chair 6 can be provided with one of the above-mentioned adjustable harness 2, 4 and 5. In principle, the chair 1 in the above embodiments can be used as the chair 6. The descriptions for the adjustable harness 2, 4 and 5 will not be described herein. The following will be concentrated on the recliner handle. The chair 6 includes the backrest 62, a seat plate, a recliner mechanism, a single-structured handle 64 and a resilient member 66. The backrest 62 has a guiding slot 622, formed on the backrest 62, an inlet space 624, formed on the backrest 62 and communicating with the guiding slot 622, and a one-time snap 626, disposed at the inlet space 624. The backrest 62 is disposed above the seat plate. The recliner mechanism is used for constraining the backrest 62 to be disposed at a slanted angle relative to the seat plate and includes a recliner wire 68. The single-structured handle 64 is connected to the recliner mechanism and passes through and slides on the guiding slot 622, for driving the recliner mechanism.

In the embodiment, the single-structured handle 64 is molded in one piece and has a handle body 642 and a retaining portion 644, disposed to be connected with each other at two sides of the guiding slot 622. The handle body 642 is connected to the recliner wire 68 for driving the recliner mechanism. The profile of the inlet space 624 is larger than the profile of the retaining portion 644. In practice, the single-structured handle 64 is assembled to the guiding slot 622 by inserting the retaining portion 644 into the inlet space 624 and moving upward the handle body 642. When the single-structured handle 64 is normally assembled to the guiding slot 622, the one-time snap 626 can obstruct the retaining portion 644 from getting into the inlet space 624 for preventing the single-structured handle 64 from being disengaged from the guiding slot 622.

In the embodiment, the resilient member 66 has two arm portions. Each arm portion is connected to the handle body 642 and the backrest 62 and is made of resilient material so as to be capable of being resiliently deformed by moving the single-structured handle 64 along the guiding slot 622. In the embodiment, each arm portion is bar-shaped and can serve the same function and force as a spring. In practice, the resilient member 66 can be molded together with the single-structured handle 64. In such case, one end of the arm portion is molded into the handle body 642; the other end can be constrained on the backrest 62 such as by inserting into a slot formed on the backrest 62. Thereby, the resilient member 66 can provide a restoring force to the single-structured handle 64 when the single-structured handle 64 moves. Therefore, the assembly of the single-structured handle 64 and the resilient member 66 onto the backrest 62 can be implemented without additional fixtures such as screws.

Figure 15:
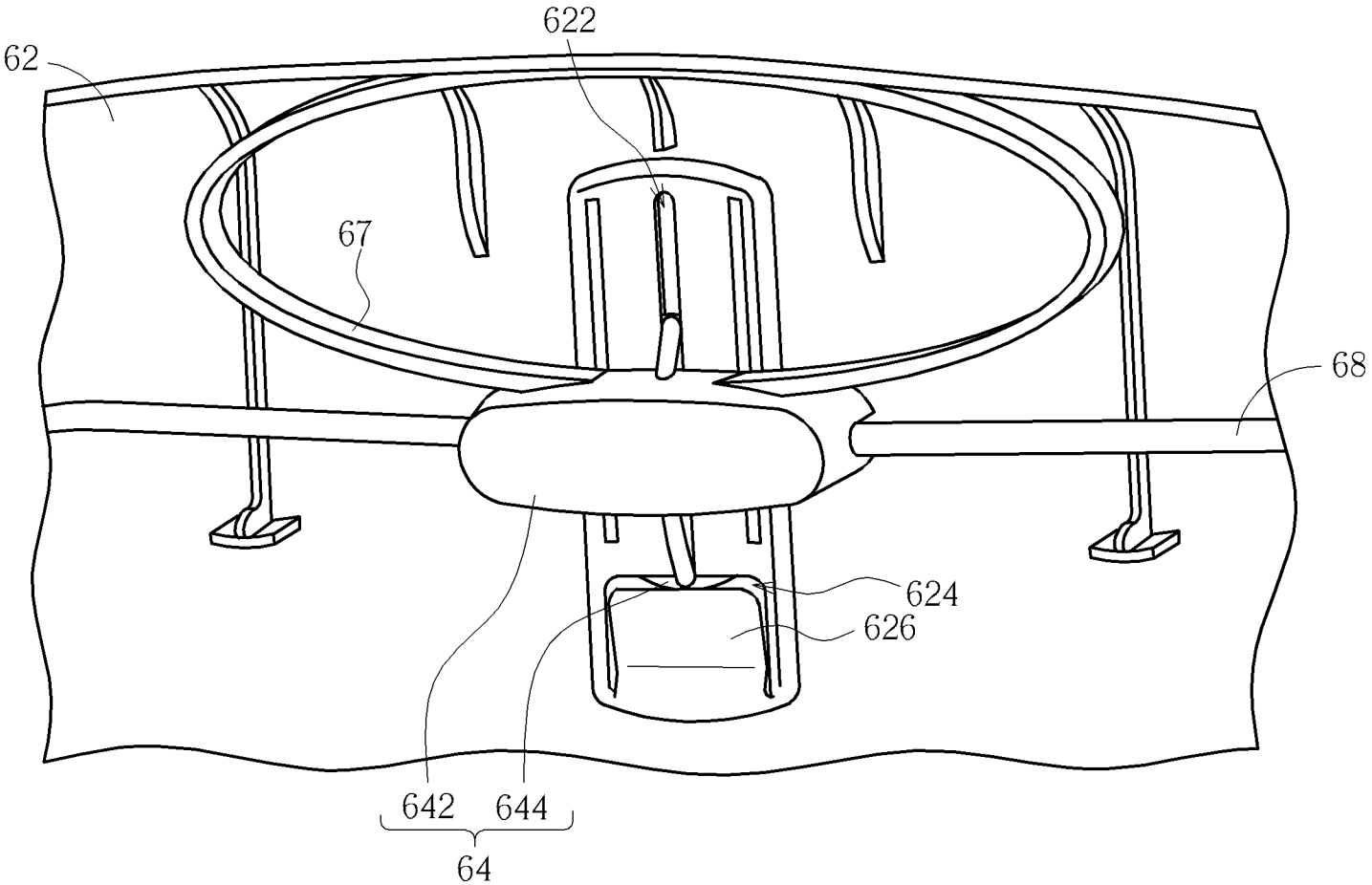
FIG. 15 is a schematic diagram illustrating the backside of a backrest of the chair in FIG. 13 with a different resilient member.

It is added that, the resilient member of the invention is not limited to the above embodiment. In practice, the resilient member can be molded in various different forms to achieve a force on the recliner wire 68 through the handle body 642. For example, the resilient member can be molded in a ring-shaped structure 67, as shown in FIG. 15. When the handle body 642 is moved upward to drive the recliner mechanism through the recliner wire 68, the ring-shaped structure 67 is compressed. So the compressed ring-shaped structure 67 can applied a downward force on the recliner wire 68 through the handle body 642.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An adjustable harness, installed on a chair, the adjustable harness comprising:

an attachment component, fixedly disposed on a backrest of the chair, two ends of the attachment component being longitudinally fixed on the backrest;

an adjustment component, disposed on the attachment component and capable of being operated to move longitudinally relative to the attachment component;

a pulling tab, disposed on the adjustment component; and a shoulder strap, an end of the shoulder strap being connected to the adjustment component, wherein the shoulder strap and the adjustment component move upward when the pulling tab is pulled upward.

2. The adjustable harness of claim 1, wherein the attachment component comprises an attachment strap, two ends of the attachment strap are mounted on the backrest, and the attachment strap passes through the adjustment component.

3. The adjustable harness of claim 2, wherein the adjustment component comprises a tri-glide buckle, the attachment strap is woven through three bars of the tri-glide buckle, and the end of the shoulder strap is attached onto a lower one of the three bars.

4. The adjustable harness of claim 3, wherein the pulling tab is attached onto an upper one of the three bars.

5. The adjustable harness of claim 3, further comprising an infant insert, attached between the tri-glide buckle and the attachment strap opposite to the shoulder strap.

6. A chair, comprising:

a backrest;

an attachment component, fixedly disposed on the backrest, two ends of the attachment component being longitudinally fixed on the backrest;

an adjustment component, disposed on the attachment component and capable of being operated to move longitudinally relative to the attachment component;

a pulling tab, disposed on the adjustment component; and a shoulder strap, an end of the shoulder strap being connected to the adjustment component, wherein the shoulder strap and the adjustment component move upward when the pulling tab is pulled upward.

7. The chair of claim 6, wherein the attachment component comprises an attachment strap, two ends of the attachment strap are mounted on the backrest, and the attachment strap passes through the adjustment component.

8. The chair of claim 7, wherein the adjustment component comprises a tri-glide buckle, the attachment strap is woven through three bars of the tri-glide buckle, and the end of the shoulder strap is attached onto a lower one of the three bars.

9. The chair of claim 8, wherein the pulling tab is attached onto an upper one of the three bars.

10. The chair of claim 8, further comprising an infant insert, attached between the tri-glide buckle and the attachment strap opposite to the shoulder strap.

11. The chair of claim 6, wherein the backrest has a guiding slot and an inlet space, communicating with the guiding slot, and the chair further comprises:

a seat plate, the backrest being disposed above the seat plate;

a recliner mechanism, for constraining the backrest to be disposed at a slanted angle relative to the seat plate;

a single-structured handle, connected to the recliner mechanism and passing through and sliding on the guiding slot, the single-structured handle having a handle body and a retaining portion, disposed to be connected with each other at two sides of the guiding slot, a profile of the inlet space being larger than a profile of the retaining portion; and a resilient member, connected to the handle body and the backrest and capable of being resiliently deformed by moving the single-structured handle along the guiding slot.

12. The chair of claim 11, wherein the resilient member is molded together with the single-structured handle.

13. The chair of claim 11, wherein the resilient member is bar-shaped or ring-shaped.

14. The chair of claim 11, further comprising a one-time snap, disposed at the inlet space, obstructing the retaining portion from getting into the inlet space.

* * * * *